US010507359B1

(12) United States Patent
Shubin Stein

(10) Patent No.: US 10,507,359 B1
(45) Date of Patent: Dec. 17, 2019

(54) CORE MUSCLE EXERCISE SYSTEM

(71) Applicant: Ken Shubin Stein, New York, NY (US)

(72) Inventor: Ken Shubin Stein, New York, NY (US)

( * ) Notice: Subject to any disclaimer, the term of this patent is extended or adjusted under 35 U.S.C. 154(b) by 158 days.

(21) Appl. No.: 15/729,906

(22) Filed: Oct. 11, 2017

(51) Int. Cl.
*A63B 26/00* (2006.01)
*A63B 23/02* (2006.01)

(52) U.S. Cl.
CPC ..... *A63B 26/003* (2013.01); *A63B 23/0205* (2013.01); *A63B 2208/0204* (2013.01)

(58) Field of Classification Search
CPC ... A63B 23/0205; A63B 26/00; A63B 26/003; A63B 2208/0204
See application file for complete search history.

(56) References Cited

U.S. PATENT DOCUMENTS 5,092,586 A * 3/1992 Tuthill ..... A63B 21/0004 482/146
5,435,320 A * 7/1995 Seitz ..... A61B 5/1036 600/595
5,603,334 A * 2/1997 Sharp ..... A61B 5/103 482/146
5,613,690 A * 3/1997 McShane ..... A63B 22/18 273/449
5,830,158 A * 11/1998 Zanakis ..... A61B 5/1036 600/595
5,919,150 A * 7/1999 Zanakis ..... A61B 5/1036 600/595
6,602,210 B2 * 8/2003 Savet ..... A61B 5/1036 600/595
7,156,790 B2 * 1/2007 Johnsen ..... A63B 21/0004 482/112
7,775,952 B1 * 8/2010 Curran ..... A63B 22/18 482/146
8,105,219 B1 * 1/2012 Sloan ..... A63B 21/0085 482/130
8,398,100 B2 * 3/2013 Tedla ..... A63C 17/004 280/11.27
9,056,222 B2 * 6/2015 Thomason ..... A63B 23/1236
9,295,879 B2 * 3/2016 Palmer ..... A63B 26/003
9,486,670 B2 * 11/2016 Maximillian ..... A63B 22/18
9,737,745 B2 * 8/2017 Hugou ..... A63B 21/0023
9,782,116 B2 * 10/2017 Lonis ..... A61B 5/4023
2003/0017922 A1 * 1/2003 Sachs ..... A63B 26/003 482/146
2004/0014571 A1 * 1/2004 Haynes ..... A63B 21/0004 482/142
2004/0023766 A1 * 2/2004 Slone ..... A63B 22/18 482/146
2006/0105895 A1 * 5/2006 Lu ..... A63B 21/0004 482/146

(Continued)

*Primary Examiner* — Joshua Lee
(74) *Attorney, Agent, or Firm* — Antonio Papageorgiou; Meister Seelig & Fein LLP

(57) ABSTRACT

An exercise system is provided for enabling a user to perform therewith an exercise of balance, the system includes: a board having a surface for a user to stand thereon, the board including a plurality of sensors configured to measure movements of the board; and a bottom element having an interface with the ground. At least one of the top element and the board is interchangeably coupled, and the system includes at least one element of instability.

19 Claims, 8 Drawing Sheets

(56) References Cited

U.S. PATENT DOCUMENTS

| | | | | |
|---|---|---|---|---|
| 2007/0138850 | A1* | 6/2007 | Oettinger | A47C 3/029 297/271.5 |
| 2008/0234116 | A1* | 9/2008 | Elzerman | A63B 21/015 482/123 |
| 2009/0189854 | A1* | 7/2009 | Schwanecke | A63B 21/0004 345/156 |
| 2009/0227426 | A1* | 9/2009 | Dubar | A63B 21/0004 482/34 |
| 2009/0275451 | A1* | 11/2009 | Chiang | A63B 22/18 482/146 |
| 2009/0303179 | A1* | 12/2009 | Overholt | A63B 22/14 345/156 |
| 2012/0264579 | A1* | 10/2012 | Klein | A63B 22/0015 482/146 |
| 2013/0178346 | A1* | 7/2013 | Lin | A63B 22/16 482/146 |
| 2013/0237395 | A1* | 9/2013 | Hjelt | A63B 22/18 482/146 |
| 2013/0288866 | A1* | 10/2013 | Rainey | A63B 26/003 482/146 |
| 2014/0011649 | A1* | 1/2014 | Carney | A63B 26/00 482/142 |
| 2014/0162858 | A1* | 6/2014 | Dalebout | A63B 23/02 482/142 |
| 2015/0251056 | A1* | 9/2015 | Crist | A63B 22/18 482/146 |
| 2017/0043219 | A1* | 2/2017 | Polinsky | A63B 26/003 |
| 2017/0056728 | A1* | 3/2017 | Todd | A63B 21/4033 |
| 2017/0095694 | A1* | 4/2017 | Polinsky | A63F 13/211 |

* cited by examiner

CORE MUSCLE EXERCISE SYSTEM

The present application relates to exercise systems and more particularly exercise systems for strengthening core muscles.

Various exercise systems exist for strengthening core muscles (e.g., abdominal, back, etc.). Some, such as the abdominal roller, are exercise-specific and thus have limited uses. Others, such as the sit-up/hyper back extension benches, although not limited to one specific exercise, are still limited. More importantly, these types of equipment presume a certain minimum level of user fitness and thus do not account for individuals that have a fitness level less than this minimum or that may be afflicted with an injury or impairment (e.g., of the back or neck) the prevents their use. Accordingly, there is a need for an exercise system that is not so limited.

SUMMARY OF THE INVENTION

In one aspect, an exercise system is provided for enabling a user to perform therewith an exercise of balance, the system includes: a board having a surface for a user to stand thereon, the board including a plurality of sensors configured to measure movements of the board; and a bottom element having an interface with the ground. At least one of the top element and the board is interchangeably coupled, and the system includes at least one element of instability.

In at least one embodiment, the movements include position, sway, and displacement.

In at least one embodiment, the plurality of sensors is further configured to measure frequency and duration of the movements of the board.

In at least one embodiment, the plurality of sensors comprise internal sensors configured to detect multi-axis position changes of the board.

In at least one embodiment, the plurality of sensors is further configured to determine a relative tilt of the board about a given axis position.

In at least one embodiment, the system is provided as a modular kit with interchangeable components that vary a degree of instability of the exercise system.

In at least one embodiment, the at least one element of instability comprises at least one wheel or caster disposed at the bottom element.

In at least one embodiment, the exercise system further comprises a computing device, the computing device configured to receive measurement data from the plurality of sensors.

In at least one embodiment, the computing device is configured to determine the user's ability to balance on the board based on the measurement data.

In another aspect, an exercise system is provided for enabling a user to perform therewith an exercise of balance, the system comprising a board having a surface for a user to stand thereon, the board including a plurality of sensors configured to measure movements of the board. The exercise system further comprises a top element having an interface for a user to hold or rest thereon, and a bottom element having an interface with the ground, the top element and the board interconnected and separated from each other with a middle element, wherein at least one of the top element and the board is interchangeably coupled to the middle element, and wherein the system includes at least one element of instability.

In at least one embodiment, the top element and the bottom element are interconnected and separated from each other with the middle element via an aperture on the board.

In at least one embodiment, the middle element is telescopically coupled to the top element and the board to adjustably separate the top element and the board from each other between a first position and a second position.

In at least one embodiment, the top element comprises a platform with a plurality of handles located thereon.

In at least one embodiment, the top element comprises a platform with means for attaching accessories to the platform.

In at least one embodiment, the exercise system further comprises at least one accessory adjustably coupled to the means for attaching accessories to the platform.

In at least one embodiment, the movements include position, sway, and displacement.

In at least one embodiment, the plurality of sensors is further configured to measure frequency and duration of the movements of the board.

In at least one embodiment, the system is provided as a modular kit with interchangeable components that vary a degree of instability of the exercise system.

In at least one embodiment, the exercise system further comprising a computing device, the computing device configured to receive measurement data from the plurality of sensors and determine the user's ability to balance on the board based on the measurement data.

In another aspect, an exercise system is provided for enabling a user to perform therewith an exercise of balance, the system comprising: a board having a surface for a user to stand thereon, the board including a plurality of sensors configured to measure movements of the board; a top element having an interface for a user to hold or rest thereon; and a plurality of bottom elements each having an interface with the ground, the board and the plurality of bottom elements interconnected and separated from each other and interchangeably interconnectable to a telescopic middle element, the middle element operable to adjustably separate the top and at least one of the plurality of bottom elements or the board from the top element between a first position and a second position, wherein a first of the plurality of bottom elements has an instability that is different than an instability of a second of the plurality of bottom elements.

Additional aspects of the present invention will be apparent in view of the description which follows.

DETAILED DESCRIPTION OF THE INVENTION

Figure 2:
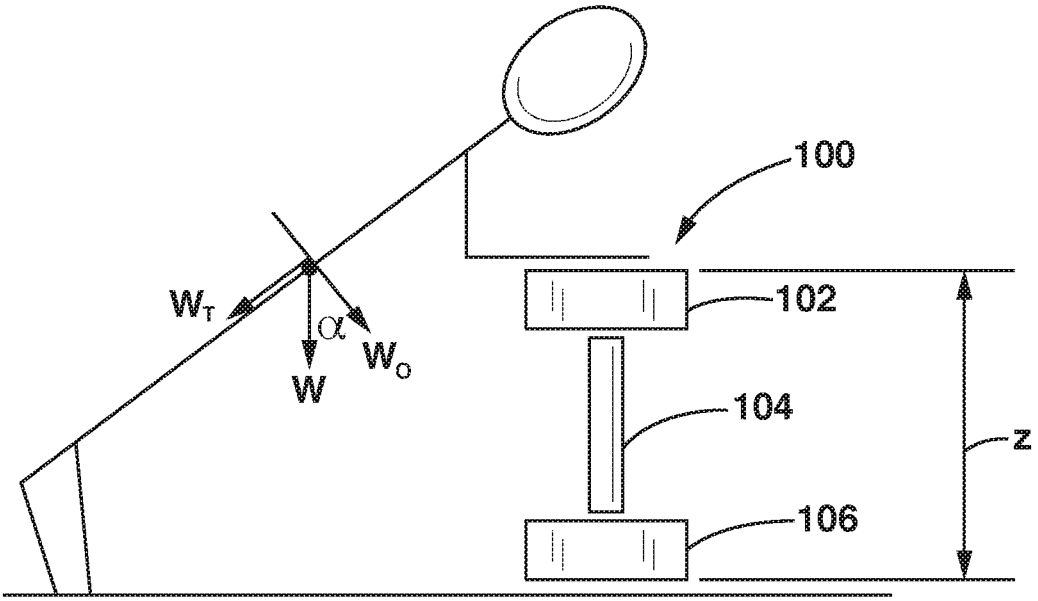
FIG. 2 is a side view depicting a representative use of the core muscle exercise system(s) disclosed herein.

The present application generally provides an exercise system for strengthening core muscles, which has a difficulty that is progressively adjustable (as discussed in greater detail below) to accommodate users having minimal fitness and/or a physical injury or impairment that would otherwise be unable to perform exercises targeting the core muscles. The exercise system is primarily designed to be used to modify traditional bodyweight exercises, such as the forearm plank, as shown in FIG. 2. The forearm plank is generally executed by lying on the floor with elbows and forearms flat against the floor and the torso raised to form a straight between the shoulders and ankles. Variations include the standard, knee and side planks. As can be appreciated, an individual with a back injury, for example, can have great difficulty even assuming the initial position of such bodyweight exercises. The exercise system of the present application generally varies the difficulty by lessening the user's bodyweight orthogonal to the user's back from between about 0% to about 100% and/or introduces one or more elements of instability that involve the user's core muscles, as explained in greater detail below. According to another aspect, the present application discloses a balance board apparatus for measuring balance and brain function by collecting data from sensors that may be configured on the balance board apparatus.

Figure 1:
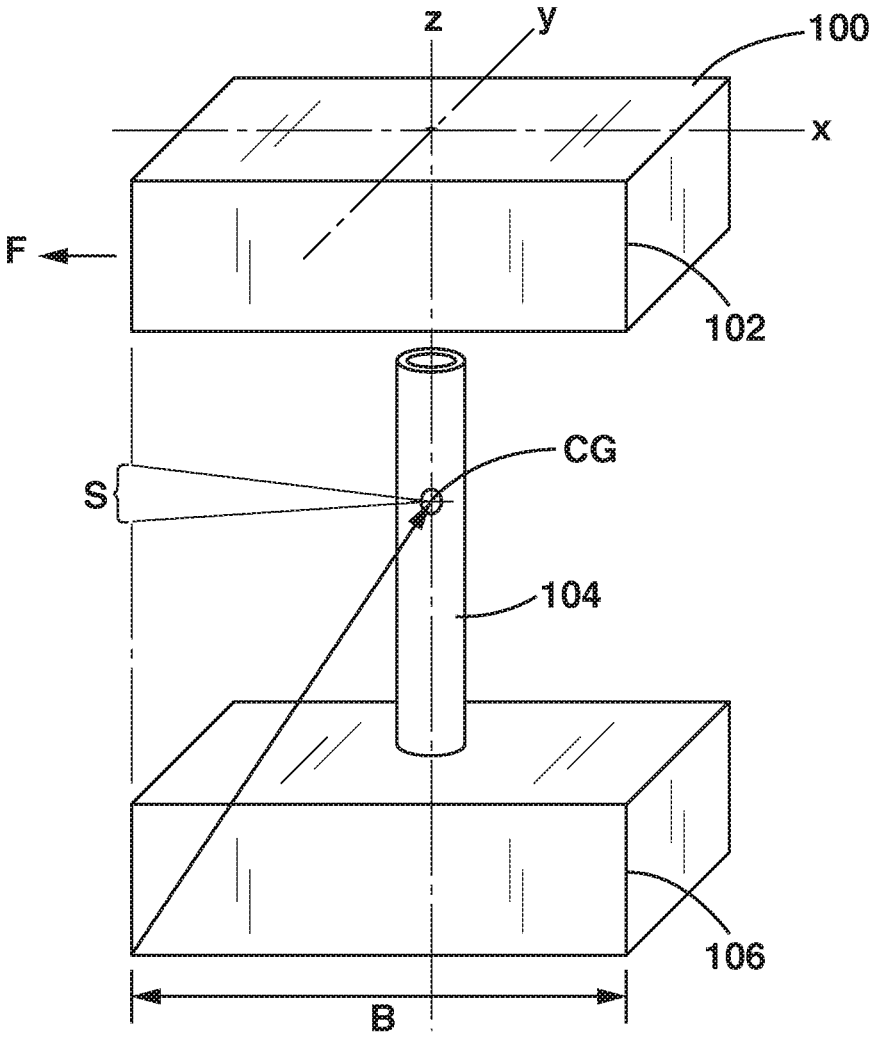
FIG. 1 is a perspective view depicting the components of a core muscle exercise system (in block form) according to at least one embodiment of the systems disclosed in the present application.

Referring to FIG. 1, the exercise system 100, includes a top element 102 and a bottom element 106, interconnected with middle element 104. The elements may be fixed with each other or preferably removable attachable to each other, as explained below. With regard to the latter, the system 100 may be provided as a modular kit with interchangeable components, each varying the degree of instability of the exercise system 100. For example, a first bottom element 106 may have a planar interface with the ground with a certain instability associated therewith as a function of the characteristics of the contact area with the ground and the center of gravity of the system (e.g., FIG. 3E generally considered stable at equilibrium), whereas as a second bottom element 106 may have a pivotal interface with the ground with a higher degree of instability (e.g., FIGS. 3A-3D generally considered unstable at equilibrium).

Figure 5:
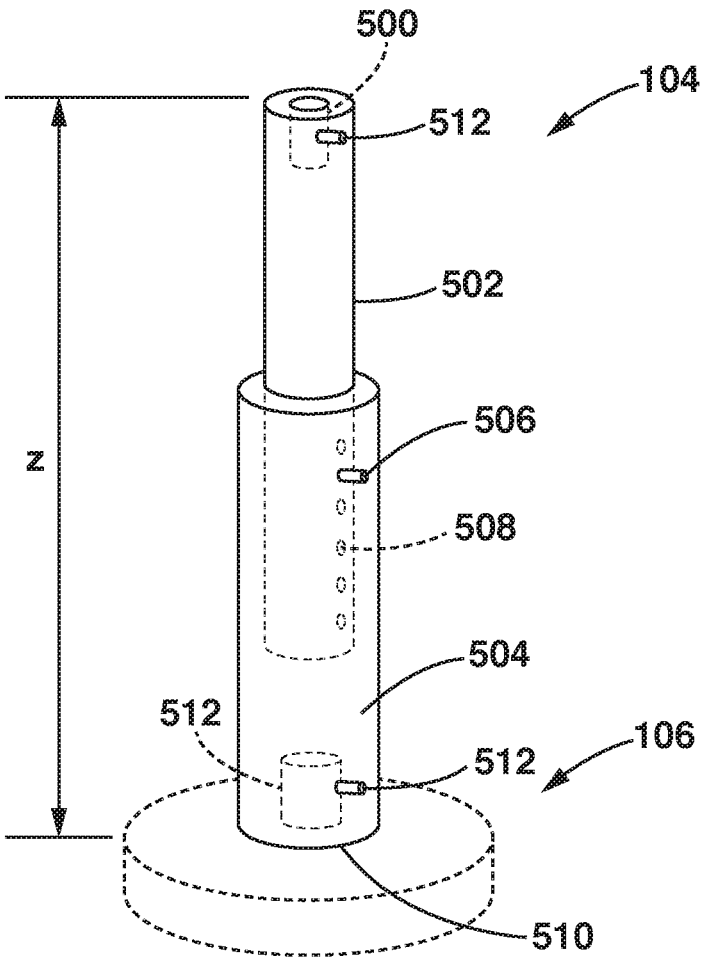
FIG. 5 is a perspective view depicting an intermediate component of the core muscle exercise system(s) disclosed herein.

Referring to FIG. 2, the exercise system 100 may be used to perform a modified plank. As can be seen, the system 100 is placed between the user and the ground to elevate the user a distance Z therefrom. This elevation Z varies the bodyweight acting orthogonal to the user's back ($W_o$). That is, varying Z will vary the angle of inclination $\alpha$ and will correspondingly vary $W_o$. In other words, $W_o$ is a function of Z and $\alpha$. In this regard, Z may be sufficiently tall so that the user is nearly upright or standing in which instance $W_o$ will be about 0% of the user's weight W. Similarly, Z may be sufficiently low so that $W_o$ is about 100% of the user's weight W. The exercise system 100 is preferably adjustable to vary the elevation of the system Z, such as with an adjustable middle element 104 as shown in FIG. 5. As can be appreciated, a user with minimal fitness or function as a result of, e.g., a back injury can begin core exercises with the adjustable middle element 104 in the highest position for the particular user. This will allow the user to involve some of the core muscles at least minimally without overstressing the back muscles. As the user progresses, the middle element 104 may be lowered to involve more of the core muscles (including the back). Although the present system is discussed in relation to back injury, it is understood that any injury or limitation may be addressed with the presently disclosed system, including without limitation hip, knee, shoulder, neck, and a myriad foot problems.

As indicated above, varying degrees of instability may be used alone or with the variable elevation Z to involve more of the user's core muscles. This generally entails selecting a top and/or bottom element 102, 106 with the desired instability. For example, a user may set up the system 100 initially at the highest elevation Z and a relatively stable bottom element 106 (e.g., FIG. 3E). In this instance, some of the user's weight will involve essentially on the deltoid, trapezius, and/or latissimus dorsi muscles (not unlike the use of a walker type assistive device). As the user progresses, the stable bottom element 106 may be replaced with an unstable bottom element 106 (e.g., FIGS. 3A-3D). Even though upright, the instability in the bottom element 106 may require the user to balance the system 100 thereby involving more core muscles, such as the obliques. As the user progresses even further, additional instability and/or resistance may be added by, for example, varying the stability with regard to the bottom element 106, top element 102 and/or lowering the elevation Z via middle element 104.

Figure 3A:
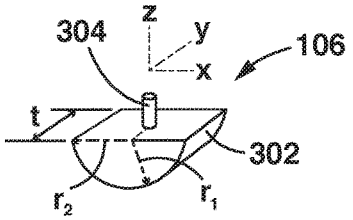
FIGS. 3A-3F depict various embodiments of a base component of the core muscle exercise system(s) disclosed herein.
Figure 3B:
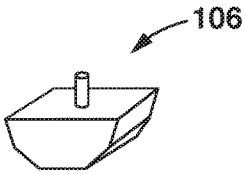
Figure 3C:
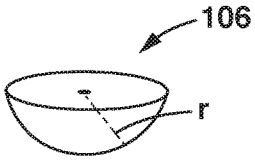
Figure 3D:
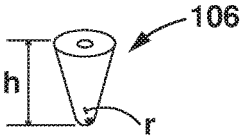
Figure 3E:
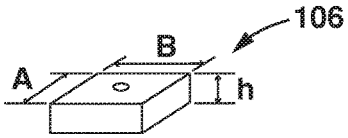

Referring to FIGS. 3A-3F, exemplary bottom elements 106 with varying instability are shown. The bottom element 106 generally has a structure 302 with a mechanism 304 for removably attaching the middle element 104 thereto. This may simply include a post that is received within an aperture and selectively affixed to the middle element 104 (show in FIG. 5). Although shown centrally disposed on the bottom element 106, the attachment mechanism may be offset to provide different left vs. right and fore vs. aft stability. As indicated above, the bottom element 106 may be stable at equilibrium. That is, the system 100 will tend to tilt with the application of a force F and return back to the original position with the removal of that force, as shown in FIG. 1. As also shown in FIG. 1, the center of gravity (CG) of the system 100 in the stable embodiment will rise a distance S along the z-axis in an orthogonal reference system as the system 100 tilts. The distance S is a function of the base B. In this regard, the magnitude of S is representative of the relative stability of the system 100. Referring to FIG. 3E, the stable base may be a square (A=B) or a rectangle (A>B). With regard to the latter, the stable base will have different instability with regard to tilting about the x-axis of the orthogonal reference system as compared to the instability about the y-axis of the orthogonal system (i.e., $S_A>S_B$). With an offset attachment mechanism 304 having an offset toward the right side or toward the front of the bottom element 106, the stability can be represented as $S_{AL}>S_{AR}$ and $S_{AR}>S_{AF}$, respectively.

Figure 3F:
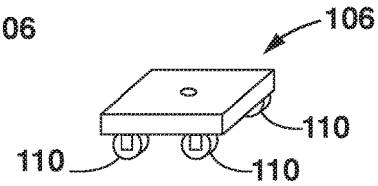

Referring to FIG. 3A, the bottom element may be stable in one plane and unstable in another plane. That is, the distance S may be greater than zero relative to tilting about the x-axis (where S is a function of t) and zero relative to in the y-axis (i.e., no rise in the z-axis by the CG as the system tilts about the y-axis). The shape of the unstable face of the bottom element 106 may be circular or elliptical (FIG. 3A $r_1=r_2$ or $r_1<r_2$, respectively), a polygon (FIG. 3B), etc. The bottom element 106 may be unstable about both the x-axis and y-axis (as show in FIGS. 3C (semi-spherical/ellipsoidal) and 3D (conical with or without a semi-spherical/ellipsoidal tip). In at least one embodiment, the system 100 is made less stable with the additions of wheels or casters that allow the system 100 to roll in one or a plurality of directions (FIG. 3F). In this regard, the wheels or casters may have a locking mechanism that restricts all or some movement in or a plurality of the wheels or casters.

Figure 4:
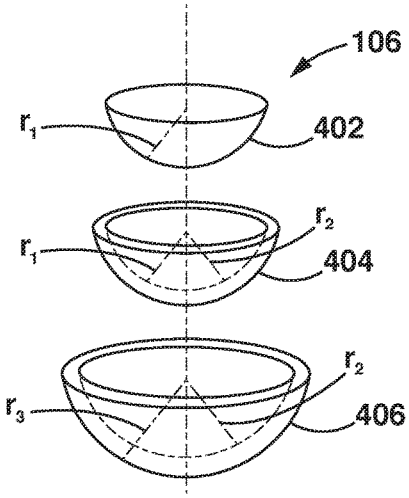
FIG. 4 depict another embodiment of a base component of the core muscle exercise system(s) disclosed herein.

Referring to FIG. 4, the bottom element 106 itself may have an adjustable stability. That is, the stability of the bottom element 106 may vary by adjustably increasing the footprint or contact area of the unstable bottom element 106. In one embodiment, this is achieved with a semi-spherical/ellipsoidal bottom element 402 with attachments 404, 406 that fit over the bottom element 402 to effectively increase the radius from $r_1$-$r_3$. The contact area may also be increased/decreased with an inflatable bottom element 106 by varying the pressure within the bottom element 106. That is, lower pressure will increase the contact area with the ground and correspondingly provide more grip thereby stabilizing the system 100. Increasing pressure will reduce the contact area thereby decreasing the stability of the system 100. Stability may also be varied by lowering or raising the center of gravity of the system 100. This can be achieved with lighter and/or heavier top and/or bottom elements.

Figure 8:
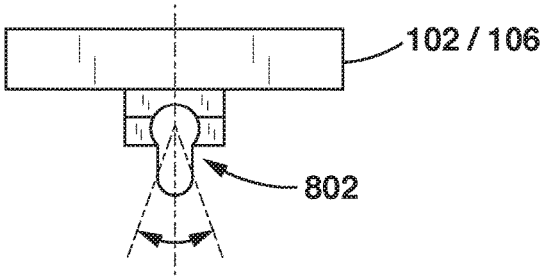
FIG. 8 depicts a representative mechanism for interconnecting core muscle system components.

Referring to FIG. 5, in at least one embodiment, the middle element 104 is adjustable to vary the height Z of the system 100. This may be achieved various ways, including a telescopic arrangement, as shown, having an inner member 502 slidingly and adjustably coupled to an outer member 504. The inner and outer members may be fixed relative to each other via pin or button 506 that engage apertures 508. The middle element 104 preferably includes a top attachment mechanism for removably attaching the middle element 104 to the top element 102, and a bottom mechanism 510 for removably attaching the middle element 104 to the top element 102. As indicated elsewhere, this detachability may be achieved with a post that fits into apertures 500, 510 in the middle element 104 and affixed thereto via one or more pins or other locking mechanism 512. The top and/or bottom elements may be attached via swivel connections 802 (FIG. 8) to the middle element 104. The swivels may allow pivotal movement in various degrees of freedom, including pivoting left and right, and fore and aft, and rotational movement about the middle element 104 axis. The system 100 may include a mechanism to lock or otherwise prevent one or a plurality of these movements.

Figure 6A:
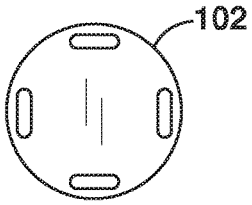
FIGS. 6A-C depict various embodiments of a top component of the core muscle exercise system(s) disclosed herein.
Figure 6B:
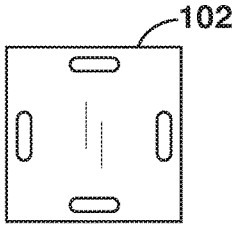
Figure 6C:
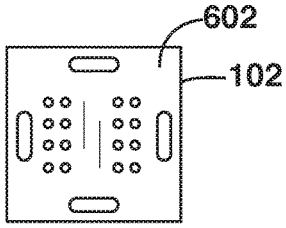

Referring to FIGS. 6A-6C, various embodiment of the top element 102 are shown. The top element 102 is generally an item that provides an interface for the user to hold or rest on the top element, such as a platform with a plurality of handles. The platforms may be any shape, including circular, square, rectangular, etc. The platforms 102 may further include means for attaching accessories thereto. For instance, the platform may include one or more, or preferably a plurality of rows of accessory apertures 602 for releasably attaching accessories to the top of the platform 102. The apertures rows 602 are preferably aligned and parallel to accommodate various sized users. The spacing may also be used to target different core muscles or core muscles from different directions.

Figure 7:
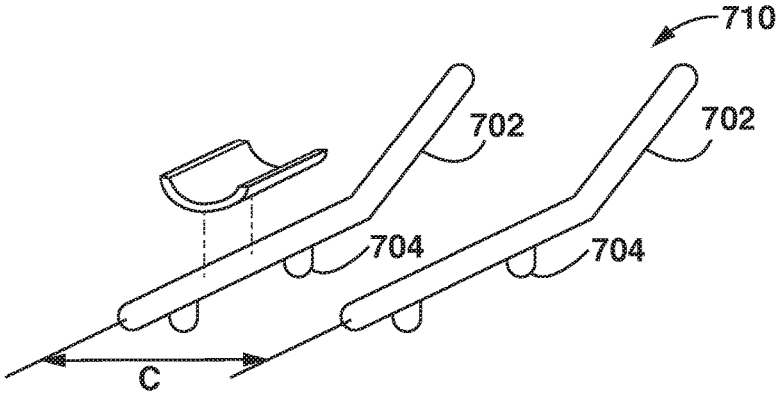
FIG. 7 is a perspective view depicting an accessory attachable to the top component of the core muscle exercise system(s) disclosed herein.

Referring to FIG. 7, an accessory 700 for use with the top element 102 includes one or preferably a plurality of forearm rests 702. These rests include pegs 704 that engage the apertures 602. As can be appreciated, users may insert the pegs 704 offset relative to the center of the platform. For instance, the accessories may be offset toward the front, which will create a different stability in the system 100 by correspondingly offsetting the center of gravity of the system 100 in use. Similarly, the accessories may be spaced apart laterally to increase the leverage by the user against the instability of the system 100.

Figure 9:
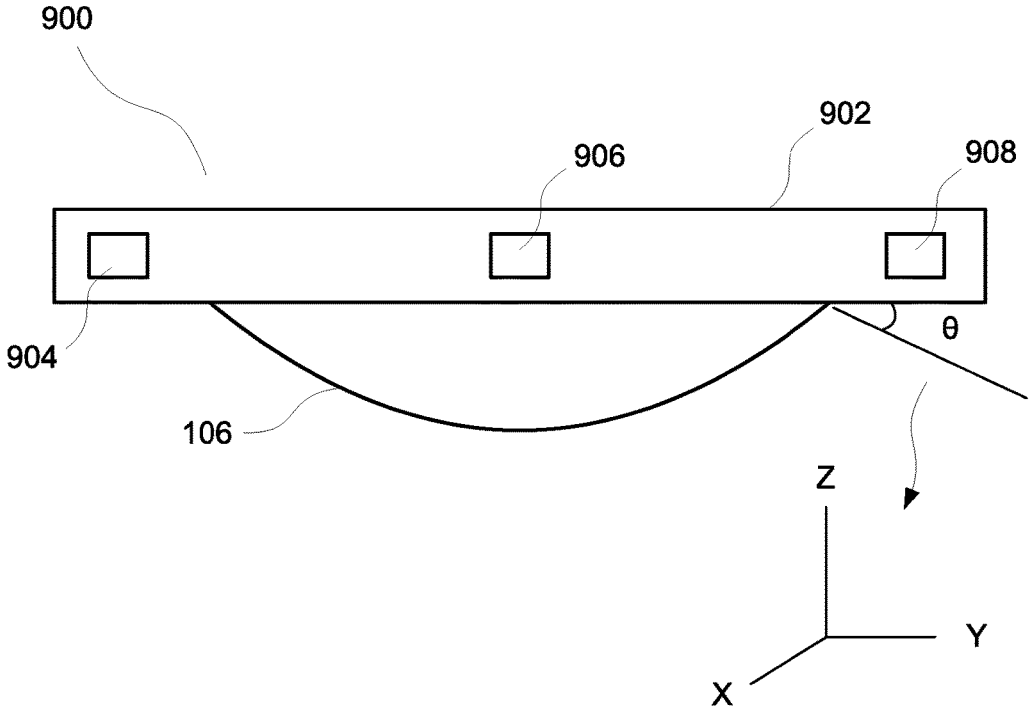
FIG. 9 depicts a side view of depicting the components of a balancing exercise system according to at least one embodiment of the systems disclosed.

Referring to FIG. 9, a balance board apparatus 900 comprises a board 902 that may be removably attached to the bottom element 106. A user may use balance board apparatus 900 to develop or train the user's balance by standing on the surface of board 902 and maintaining a stabilized or balanced position. Board 902 may be any shape, including circular, square, rectangular, etc. In one embodiment, board 902 may be in the shape of a skateboard.

Balance board apparatus 900 may be provided as a modular kit with interchangeable bottom element 106. Bottom element 106 can be interchanged to vary the degree of instability of the balance board apparatus 900. For example, a first bottom element 106 may have a planar interface with the ground with a certain instability associated therewith, whereas as a second bottom element 106 may have a pivotal interface with the ground with a higher degree of instability. The bottom element 106 may also be any shape that includes an interface with the ground that is either flat, rounded, or a combination thereof that may vary depending on a movement of bottom element 106 about the x-axis, y-axis, and z-axis. Additionally, both board 902 and bottom element 106 may be interchanged to adjust overall size, diameter, and surface area with the ground to vary difficulty of balancing. According to an alternative embodiment, bottom element 106 may include moving objects such as wheels or casters that allow balance board apparatus 100 to roll in one or a plurality of directions.

A plurality of sensors 904, 906, and 908 may be configured on board 902 to measure movements (e.g., position, sway, displacement), frequency and duration of movements and/or contacts made with the ground by board 902. Data measurements may be gathered by the sensors 904, 906, and 908 and used to assess balance and compute scores (e.g., to measure progress). The sensors may comprise internal sensors (or sensors embedded within board 902) that can detect multi-axis position (e.g., x-axis, y-axis, and z-axis) changes of the board 902 for advanced analysis and training of mobility, stability, and balance. Detecting position changes may further include determining relative tilt θ of board 902 about a given axis position. The board 902 is not limited to the arrangement and number of sensors in the exemplary apparatus illustrated in FIG. 9, but rather are for explanation.

The measurement data may be used to monitor balance training progress, assess brain functionality related to balance, equilibrium and coordination, as well as detecting and monitoring concussion symptoms. Balance board apparatus 900 may be communicatively coupled to a computing device including software that may receive the measurement data from sensors 904, 906, and 908 to generate scores and other statistics to monitor and evaluate user balancing functions. According to one embodiment, scores generated from the measurement data may be used in conjunction with a balance training aid or software program installed on a computing device configured to improve a user's balancing ability. The balance training aid or software may measure the user's ability to balance himself/herself on balance board apparatus 900 and compare the measurement with a baseline to compute a score. The user may be instructed to take a test to determine a baseline score. For example, the user may be asked to stand on board 902 with his/her feet and maintain their balance on balance board apparatus 900 to the best of his/her abilities for a duration of time, such as, three-minutes. The test may include how many times board 902 touches the ground within the duration of time and how much movement was detected by the sensors 904, 906, and 908 within the duration of time.

The comparison may be used to determine whether the user's measurements are consistent with average measurements from a given population, e.g., according to age group, sex, weight, height, fitness level, etc. Additionally, the score may be used to improve the user's balancing ability by providing training targets such as directing the user to maintain his/her balance on balance board apparatus for given durations and frequencies. In another embodiment, balance board apparatus 900 may be used as a tool for detecting and monitoring concussion symptoms. For example, using the balance board apparatus 900, a given athlete may be measured for their balancing ability to establish a baseline score. The athlete may be tested for concussion by measuring their balancing ability again and comparing a current score with the baseline score. For example, a current score that is significantly lower than the baseline score may indicate a high probability of concussion. The athlete may be suspended from further activities until he/she is able to generate a passing score based on the baseline score.

Figure 10:
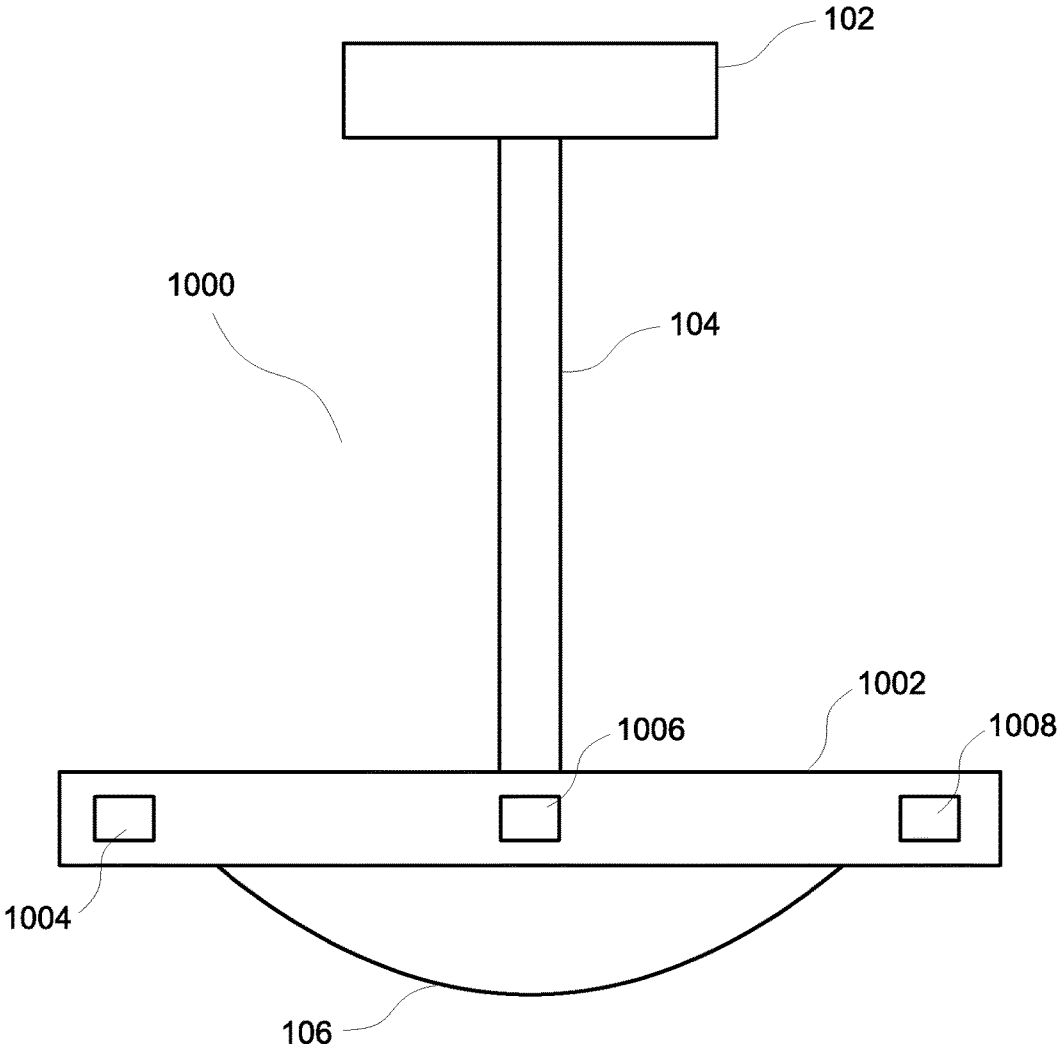
FIG. 10 depicts a side view of depicting the components of a balancing exercise system according to at least another embodiment of the systems disclosed.

Referring to FIG. 10, in an alternative embodiment, a balance board apparatus 1000 comprises a board 1002 that may be removably attached to the bottom element 106. The board 1002 is further removably attached to the middle element 104. The middle element 104 may include a top attachment mechanism for removably attaching the middle element 104 to the top element 102, and a bottom mechanism for removably attaching the middle element 104 to the board 1002. Alternatively, the bottom mechanism may removably attach the middle element 104 to the bottom element 106 through board 1002 via an aperture on board 1002. Sensors 1004, 1006, and 1008 may be configured on board 1002 to measure movements, frequency and duration of movements and/or contacts made with the ground by board 902. Balance board apparatus 1000 can be communicatively coupled to a computing device including software that may receive the measurement data from sensors 1004, 1006, and 1008 to generate scores and other statistics to monitor and evaluate user balancing functions, as described with reference to FIG. 9.

Figure 11A:
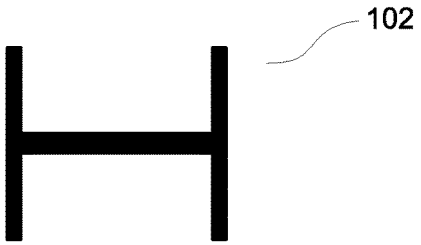
FIGS. 11A-11D depicts various embodiments of a top component of the core muscle exercise system(s) disclosed herein.
Figure 11B:
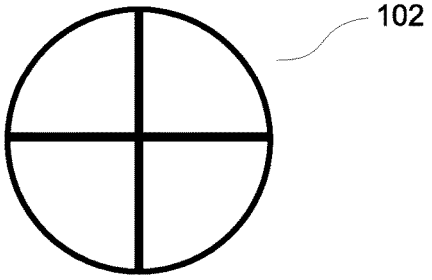
Figure 11C:
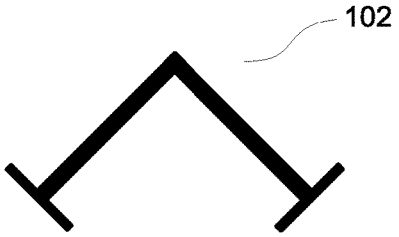
Figure 11D:
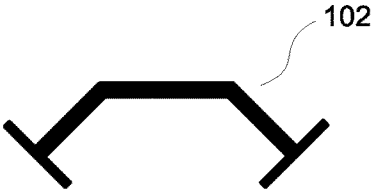

Referring to FIGS. 11A-11D, top element 102 may further comprise handle bars of different shapes and sizes. The top element 102 is generally an item that provides an interface for the user to hold or rest on the top element 102, such as a platform with a plurality of handles. The handles may be interchange to adjust or vary gripping positions. FIG. 11A depicts an exemplary top view of top element 102 that includes a H-shaped handle while FIG. 11B depicts an exemplary top view of top element 102 that includes a steering wheel-shaped handle. FIGS. 11C and 11D depict exemplary side views of top element 102 including handles according to additional embodiments. The heights of the handles may be adjustable or fixed via either top element 102 or middle element 104.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. An exercise system enabling a user to perform therewith an exercise of balance, the system comprising:

a board having a surface for a user to stand thereon, the board including a plurality of sensors configured to generate measurement data based on movements of the board, the measurement data is received by a computing device that determines a probability of concussion based on a baseline score of an initial ability to balance on the board and a current score of a current ability to balance on the board, the score determined based on the sensor generated measurement data;

a top element having an interface for a user to hold or rest thereon;

a middle element that is telescopically coupled to the top element and the board to adjustably separate the top element and the board from each other between a first position and a second position; and a bottom element having an interface with the ground, wherein the top element and the bottom element are interconnected and separated from each other with the middle element, wherein at least one of the board and the bottom element is interchangeably coupled, and wherein the system includes at least one element of instability.

2. The exercise system of claim 1 wherein the movements include position, sway, and displacement.

3. The exercise system of claim 1 wherein the plurality of sensors is further configured to measure frequency and duration of the movements of the board.

4. The exercise system of claim 1 wherein the plurality of sensors comprise real sensors configured to detect multi-axis position changes of the board.

5. The exercise system of claim 4 wherein the plurality of sensors is further configured to determine a relative tilt of the board about a given axis position.

6. The exercise system of claim 1 wherein the system is provided as a modular kit with interchangeable components that vary a degree of instability of the exercise system.

7. The exercise system of claim 1 wherein the at least one element of instability comprises at least one wheel or caster disposed at the bottom element.

8. The exercise system of claim 1 further comprising a computing device, the computing device configured to receive measurement data from the plurality of sensors.

9. The exercise system of claim 8 wherein the computing device is configured to determine the user's ability to balance on the board based on the measurement data.

10. An exercise system enabling a user to perform therewith an exercise of balance, the system comprising:

a board having a surface for a user to stand thereon, the board including a plurality of sensors configured to generate measurement data based on movements of the board, the measurement data is received by a computing device that determines a probability of concussion based on a baseline score of an initial ability to balance on the board and a current score of a current ability to balance on the hoard, the score determined based on the sensor generated measurement data;

a top element having an interface for a user to hold or rest thereon;

a middle element that is telescopically coupled to the top element and the board to adjustably separate the top element and the board from each other between a first position and a second position; and a bottom element having an interface with the ground, the top element and the board interconnected and separated from each other with the middle element, wherein at least one of the top element and the board is interchangeably coupled to the middle element, and wherein the system includes at least one element of instability.

11. The exercise system of claim 10 wherein the top element and the bottom element are interconnected and separated from each other with the middle element via an aperture on the board.

12. The exercise system of claim 10, wherein the top element comprises a platform with a plurality of handles located thereon.

13. The exercise system of claim 10, wherein the top element comprises a platform with means for attaching accessories to the platform.

14. The exercise system of claim 13, comprising at least one accessory adjustably coupled to the means for attaching accessories to the platform.

15. The exercise system of claim 10 wherein the movements include position, sway, and displacement.

16. The exercise system of claim 10 wherein the plurality of sensors is further configured to measure frequency and duration of the movements of the board.

17. The exercise system of claim 10 wherein the system is provided as a modular kit with interchangeable components that vary a degree of instability of the exercise system.

18. The exercise system of claim 10 further comprising a computing device, the computing device configured to receive measurement data from the plurality of sensors and determine the user's ability to balance on the board based on the measurement data.

19. An exercise system enabling a user to perform therewith an exercise of balance, the system comprising:

a board having a surface for a user to stand thereon, the board including a plurality of sensors configured to generate measurement data based on movements of the board, the measurement data is received by a computing device that determines a probability of concussion based on a baseline score of an initial ability to balance on the board and a current score of a current ability to balance on the board, the score determined based on the sensor generated measurement data;

a top element having an interface for a user to hold or rest thereon; and a plurality of bottom elements each having an interface with the ground, the board and the plurality of bottom elements interconnected and separated from each other and interchangeably interconnectable to a telescopic middle element, the middle element operable to adjustably separate the top and at least one of the plurality of bottom elements or the board from the top element between a first position and a second position, wherein a first of the plurality of bottom elements has an instability that is different than an instability of a second of the plurality of bottom elements.

* * * * *